US006467387B1

(12) United States Patent
Espinosa et al.

(10) Patent No.: US 6,467,387 B1
(45) Date of Patent: Oct. 22, 2002

(54) APPARATUS AND METHOD FOR PROPELLING A DATA SENSING APPARATUS INTO A SUBSURFACE FORMATION

(75) Inventors: Frank Espinosa, Richmond, TX (US); Reinhart Ciglenec, Katy, TX (US); Colin Longfield, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/681,135

(22) Filed: Jan. 19, 2001

Related U.S. Application Data

(60) Provisional application No. 60/227,801, filed on Aug. 25, 2000.

(51) Int. Cl.[7] ..... B64D 1/04

(52) U.S. Cl. ..... 89/1.15; 102/326; 102/328; 175/4.58; 340/856.2; 89/1.151

(58) Field of Search ..... 175/4.58, 4.59; 89/1.15; 102/326, 327, 328; 340/856.2

(56) References Cited

U.S. PATENT DOCUMENTS

| | | | | | |
|---|---|---|---|---|---|
| 2,262,925 | A | * | 11/1941 | Cole | 102/430 |
| 2,326,406 | A | * | 8/1943 | Spencer | 175/4.56 |
| 2,391,932 | A | * | 1/1946 | Turechek | 175/4.59 |
| 2,559,687 | A | | 7/1951 | Thomas | 166/1 |
| 2,590,366 | A | * | 3/1952 | Atwood | 175/4.58 |
| 2,672,195 | A | | 3/1954 | Allen | 164/5 |
| 2,700,336 | A | * | 1/1955 | Sliitto et al. | 102/202.11 |
| 2,953,971 | A | * | 9/1960 | Porter | 89/1.15 |
| 3,180,221 | A | * | 4/1965 | Porter | 89/1.15 |
| 3,236,317 | A | * | 2/1966 | VenHiattis | 175/4.58 |
| 3,367,429 | A | * | 2/1968 | Porter | 175/4.58 |
| 3,376,375 | A | * | 4/1968 | Porter | 175/4.58 |
| 3,528,000 | A | | 9/1970 | Schwede | 324/5 |
| 3,934,468 | A | | 1/1976 | Brieger | 73/155 |
| 4,339,947 | A | | 7/1982 | Wiley | 73/151 |
| 4,450,717 | A | * | 5/1984 | Wiley | 73/864.44 |
| 4,648,470 | A | * | 3/1987 | Gambertoglio | 166/55.1 |
| 4,860,581 | A | | 8/1989 | Zimmerman et al. | 73/155 |
| 4,893,505 | A | | 1/1990 | Marsden et al. | 73/155 |
| 4,936,139 | A | | 6/1990 | Zimmerman et al. | 73/155 |
| 5,031,536 | A | | 7/1991 | Barker et al. | 102/202.5 |
| 5,065,619 | A | | 11/1991 | Myska | 73/155 |
| 5,165,274 | A | | 11/1992 | Thiercelin | 73/151 |
| 5,195,588 | A | | 3/1993 | Dave | 166/255 |
| 5,622,223 | A | | 4/1997 | Vasquez | 166/264 |
| 5,692,565 | A | | 12/1997 | MacDougall et al. | 166/264 |
| 5,765,637 | A | | 6/1998 | Dietle et al. | 166/55 |
| 5,801,642 | A | * | 9/1998 | Meynier | 181/108 |
| 6,028,534 | A | | 2/2000 | Ciglenec et al. | 340/856.2 |
| 6,070,662 | A | | 6/2000 | Ciglenec et al. | 166/254.1 |
| 6,295,912 | B1 | * | 10/2001 | Burleson et al. | 102/275.12 |

FOREIGN PATENT DOCUMENTS

| | | |
|---|---|---|
| EP | 0 882 871 | 12/1998 |
| EP | 0 984 135 | 3/2000 |

OTHER PUBLICATIONS

Bell, et al., Perforating, 1995, Ricardson, Texas, pp. 8–24.
European Search Report dated Nov. 19, 2001.

* cited by examiner

*Primary Examiner*—Michael J. Carone
*Assistant Examiner*—Denise J. Buckley
(74) *Attorney, Agent, or Firm*—J.L. Jennie Salazar

(57) ABSTRACT

An apparatus and method are provided for deploying a data sensing apparatus into a subsurface geologic formation for intermittent or continuously gathering data from the subsurface formation and transmitting the data to a remote data receiver. In a preferred embodiment, a non-linear arrangement of a barrel and a burn chamber is used to provide a gun-like device for firing a bullet-shaped data sensing apparatus into a formation of interest. The data sensing apparatus, once disposed within the matrix of the formation of interest, monitors formation conditions and transmits the data for use in optimizing drilling and production activities.

25 Claims, 5 Drawing Sheets

APPARATUS AND METHOD FOR PROPELLING A DATA SENSING APPARATUS INTO A SUBSURFACE FORMATION

CROSS REFERENCE TO RELATED APPLICATIONS

This application claims priority to U.S. Provisional Application No. 60/227,801 filed on Aug. 25, 2000.

BACKGROUND OF INVENTION

This invention relates generally to the monitoring of subsurface geologic formations of interest, and more particularly to ballistic deployment of a projectile data sensing apparatus into a subsurface geologic formation of interest to enable such monitoring.

Wells are drilled to recover naturally occurring deposits of hydrocarbons and other materials trapped in subsurface geological formations in the earth's crust. A slender well is drilled into the ground and directed from a drilling rig on the surface of the earth or a body of water (e.g., an ocean) to a targeted subsurface location. In conventional "rotary drilling" operations, the drilling rig rotates a drill string comprised of tubular joints of steel drill pipe connected together to form a drill string. The drill string is used to turn a bottom hole assembly (BHA) and a drill bit that is connected to the lower end of the drill string. During drilling operations, a drilling fluid, commonly referred to as drilling mud, is pumped and circulated down the interior of the drill string, through the BHA, downhole tools and the drill bit. Drilling mud flows back to the surface in the annulus between the drill string and the cased or uncased wellbore.

During the drilling phase the weight of the drilling mud is closely managed to ensure safety of the drilling rig and quality of the well. The drilling mud density is frequently adjusted using weighting agents designed to maintain the density of the drilling mud within a certain favorable range. The favorable range of mud density during drilling depends, at least in part, on the pressure of the fluids in the pores of the formation. The mud density should be sufficient to hydrostatically balance the formation pressure in order to stabilize the well and prevent unwanted entry of formation fluids into the wellbore. However, excessive mud density causes drilling mud or wellbore fluids to enter the formations possibly damaging the formation and causing well control problems due to loss of fluid from the wellbore. During drilling operations, it is highly beneficial to obtain and analyze formation data such as pressure and temperature.

The availability of reliable formation data is also a benefit after a well enters the production phase. Monitoring formation pressure and temperature, and combining that formation data with measured production and other surface data, enables engineers to better implement an optimal production flowstream designed to maximize recovery from the well. Engineers may also correlate data from adjacent production and injection wells to analyze and predict movement and depletion of reserves produced or flooded by wells completed in the formation of interest.

Existing techniques for testing formations generally include using retrievable formation testing tools. These conventional formation testing tools can be run on wireline or on the drill string for gathering formation data by positioning the formation tester adjacent to the formation of interest in the well and monitoring conditions. Formation conditions in an uncased well may be monitored with wireline formation testing tools such as those described in U.S. Pat. Nos. 3,934,468, 4,860,581, 4,893,505, 4,936,139 and 5,622,223. These methods consume substantial rig time for the removal of the drill string from the well, running the formation testing tool into the wellbore to the formation of interest to acquire formation data, then retrieving the formation tester from the well and, for further drilling or production, the drill string or production tubing must be run into the well. Also, the data available using conventional formation testing tools is available only while the retrievable formation tester is adjacent to the formation of interest.

There are also formation testing tools and methods that are intended for use in cased wellbores such as those described in U.S. Pat. Nos. 5,065,619, 5,195,588 and 5,692,565. A problem inherent for formation testers designed for use in cased wells is that most of these tools involve attempts to patch or plug casing perforations made to afford direct measure of formation fluid pressure.

Like the formation testers run into uncased wells, the formation testers for use in cased wellbores are retrievable and running of the formation tester requires expensive tripping of the drill pipe, and formation data is available only for the time the formation tester is positioned adjacent to the formation of interest.

U.S. patent application Ser. No. 09/293,859, now U.S. Pat. No. 6,234,257 filed on Apr. 16, 1999 and incorporated by reference herein, describes an impact resistant deployable formation data sensing apparatus that may be deployed into a selected formation to provide intermittent or continuous formation data by wireless transmission to data receivers. U.S. application Ser. No. 09/458,764, now abandoned filed on Dec. 10, 1999 and incorporated herein by reference, describes a propellant composition designed for use in such deployment. The present invention also relates to the effective deployment of such data sensing apparatuses into the formation of interest to intermittently or continuously gather and transmit formation data through RF, electromagnetic or telemetric communication to a data receiver. The use of deployable data sensing apparatuses for these purposes is further described in U.S. Pat. Nos. 6,028,534 and 6,070,662, the contents of which are also incorporated herein by reference.

It is an object of the present invention to provide a method and apparatus for deploying a data sensing apparatus into a subsurface geologic formation of interest from a downhole tool to obtain intermittent or continuous monitoring of formation data whether wireline or drill pipe is present in the well bore, thus eliminating or minimizing the need for tripping the well for the sole purpose of running a formation tester.

It is a further object of the present invention to provide a method and apparatus for deploying a data sensing apparatus downhole via either a wireline or a drill string.

It is a further object of the present invention to provide a method and apparatus for deploying a data sensing apparatus into a subsurface geologic formation of interest to obtain intermittent or continuous monitoring of formation data and optimized operation of production or injection from or to the well for optimal depletion of reserves from the monitored formation.

It is a further object of the present invention to provide a durable and reusable structure for deploying data sensing apparatuses into a subsurface geologic formation of interest whereby a high g-force acceleration of a bullet-shaped data sensing apparatus is reliably induced to ensure sufficient penetration and deployment of the data sensing apparatus into the formation rock matrix.

It is a further object of the present invention to provide a data sensing apparatus drill collar propellant gun that can tolerate and operate under high pressures and temperatures encountered in deep wells, and withstand the extremely high pressures and temperatures associated with the use of high energy chemical propellants to propel the data sensing apparatus into a rock formation.

It is a further object of the present invention to provide a data sensing apparatus drill collar propellant gun that is adapted to survive, without deformation, damage, or failure, the high g-forces associated with projectile launch and impact, and the pressures and temperatures resulting from the launch and impact of the data sensing apparatus.

It is a further object of the present invention to provide a method and apparatus for deploying data sensing apparatuses to a satisfactory radial penetration depth into a targeted formation rock matrix to prevent interference with subsequent well operations or damage to the data sensing apparatus during subsequent well operations.

SUMMARY OF INVENTION

The above-described objects, as well as other objects and advantages, are achieved through the present invention by a method and apparatus for deploying a data sensing apparatus into a targeted geologic formation for gathering data from the subsurface formation.

"Data sensing apparatus" as used herein preferably includes a shell having a chamber therein and adapted for sustaining forcible propulsion into a subsurface formation, and a data sensor disposed within the chamber of the shell for sensing a formation parameter such as pressure, temperature, resistivity, gamma ray, density, and neutron emissions. Preferably, the shell has a first port therein for communicating properties of a fluid present in the subsurface formation to the data sensor when the apparatus is positioned in the subsurface formation, whereby the data sensor senses at least one of the properties of the fluid. The data sensing apparatus also preferably includes an antenna disposed within the chamber for transmitting signals representative of the fluid property sensed by the data sensor.

"Gun-like" as used herein includes, but is not limited to, a device for accelerating on object to displace the object from the end of a bore. "Bullet-like" as used herein includes, but is not limited to, an object shaped with an ogive, conical or pointed cylindrical end or nose. "Non-aligned" or "not aligned" means that the axis of the barrel forms an angle, obtuse or acute, with the axis of the burn chamber. Where the burn chamber does not have a readily available axis, "non-aligned" or "not aligned" means that the centroid of the burn chamber does not intersect or coincide with the axis of the barrel.

Real time formation data provides many advantages during both the drilling and the production phases of a well. Real time formation pressure obtained while drilling enables drillers and geologists to predict the formation pressure on a "macro" level and (when provided from a number of distinct sources, such as an array of data sensing apparatuses) enables reservoir engineers to predict drilling fluid and formation pressures on a "micro" level. Using these predictions, drillers and engineers may identify and induce appropriate changes in drilling mud weight and composition to improve drilling rate and promote safety. Using remotely deployed data sensing apparatuses, real time formation data can be obtained and monitored for effective reservoir management without the loss of expensive rig time needed for running conventional formation testers to gather mere "snapshots" of well conditions.

The drill collar propellant gun of the present invention is provided within a section of drill pipe and is adapted for sustaining or imparting forcible propulsion of a data sensing apparatus into a subsurface formation using propellant compositions. The deployment apparatus has a gun-like barrel designed to receive the bullet-like data sensing apparatus and, upon firing, direct the data sensing apparatus into the deployment path. The drill collar propellant gun has a burn chamber adapted to receive the propellant and an ignition assembly designed to induce a reaction in the propellant and thereby generate extremely high pressures and temperatures. The enormous gas expansion caused by ignition and burning of the propellant, when brought to bear on a selected surface of the data sensing apparatus, enables rapid acceleration of the data sensing apparatus along the axis of the barrel and into the side wall of the formation. The ignition of the propellant may be remotely controlled by wired, RF or other electromagnetic or telemetric communication.

The drill collar propellant gun of the present invention preferably includes a barrier, such as a rupture disk, isolating the barrel from the burn chamber. The rupture disk is designed to rupture only when the pressure in the burn chamber reaches a predetermined level. The rupture disk thereby prevents premature movement of the data sensing apparatus along the limited length of the barrel, and provides an overall more efficient launch of the data sensing apparatus for formation penetration.

The drill collar propellant gun preferably also includes a muzzle cap that acts as a sacrificial barrier isolating the interior of the barrel from the drilling mud or other fluid in the wellbore. The muzzle cap is designed to seal the barrel interior from the drilling mud until the muzzle cap is sacrificed upon deployment by the data sensing apparatus. Preferably, the sacrificial barrier shatters into numerous small pieces that can be suspended in and removed by drilling mud in order to prevent interference with data sensing apparatus deployment or continued well functions.

In a preferred embodiment, the barrel is offset from the axial centerline of the drill string and directs a data sensing apparatus fired from the barrel along its radius radially outward from the approximate center of the drillsting into an adjacent rock matrix comprising the formation of interest. In a particularly preferred embodiment, the barrel is not aligned with the burn chamber in order to enable the method and apparatus to be used in a space-limited environment such as in a slender drill string. The projectile fired from the drill collar propellant gun may be similar to the data sensing apparatus described in U.S. patent application Ser. No. 09/019,466, which is incorporated by reference.

The components of the barrel and the burn chamber are adapted for ensuring survival of the drill collar propellant gun without functional failure during deployment of the data sensing apparatus into the formation. The burn chamber of the apparatus is adapted for receiving and igniting, without interference by wellbore fluids, a chemical propellant. The chemical propellant may be stored within the apparatus in the burn chamber itself where it remains until ignition. The propellant must be capable of maintaining its effectiveness without degradation after prolonged exposure to high temperatures and pressures encountered in a well. As mentioned above, the presently preferred propellant for propelling the data sensing apparatus from the drill collar propellant gun is described in U.S. patent application Ser. No. 09/458,764 now abandoned filed on Dec. 10, 1999, which is incorporated herein by reference.

In a preferable embodiment, the drill collar propellant gun has the capacity to deploy multiple data sensing apparatuses at multiple zones of interest throughout the well. Thus, while the present disclosure focuses on the method and apparatus for deployment of a single data sensing apparatus, it should be noted that the drill collar propellant gun may have an array of substantially similar devices, each capable of deploying a data sensing apparatus independently or in concert with the others. The present invention may provide an array of over a dozen substantially similar deployment apparatuses within a single elongated downhole tool in order to prevent having to trip wireline or drill pipe out of the well for each data sensing apparatus deployment.

The drill collar propellant gun of the present invention preferably includes electronic equipment for receiving and interpreting commands for controlled deployment of the data sensing apparatus at a selected depth and orientation. The apparatus may be used in cooperation with one or more positioning systems including, but not limited to, a back up shoe extendable from a side of the drill collar propellant gun and a system for angularly orienting the tool within the wellbore.

BRIEF DESCRIPTION OF DRAWINGS

So that the manner in which the above recited features, advantages and objects of the present invention are attained can be understood in detail, a more particular description of the invention, briefly summarized above, may be had by reference to the preferred embodiment thereof which is illustrated in the appended drawings.

It is to be noted however, that the appended drawings illustrate only a typical embodiment of this invention and are therefore not to be considered limiting of its scope, for the invention may admit to other equally effective embodiments.

DETAILED DESCRIPTION

Figure 1:
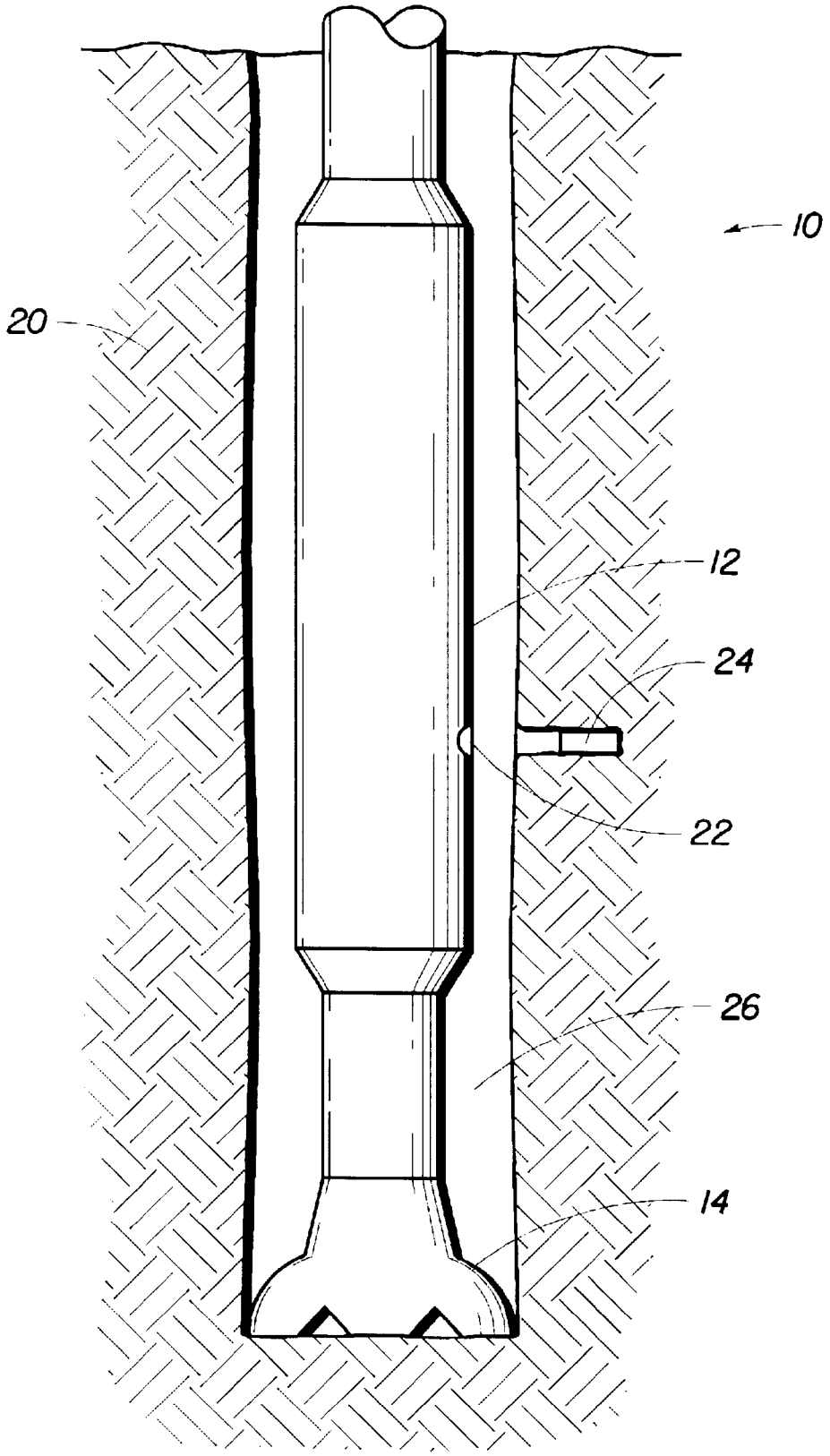
FIG. 1 is a diagram of a drill collar propellant gun contained within a drill collar following its deployment of a data sensing apparatus in accordance with the present invention.

FIG. 1 shows a drill collar propellant gun 10 within a drill collar 12 that is made up in a drill string that extends into a drilled wellbore. The drill collar propellant gun 10 has an orifice 22 from which a bullet-shaped data sensing apparatus emerges upon being fired from the drill collar propellant gun 10. A deployed data sensing apparatus 24 is shown as having been deployed from the drill collar propellant gun 10 into the formation rock matrix 20 into a formation of interest.

Figure 2:
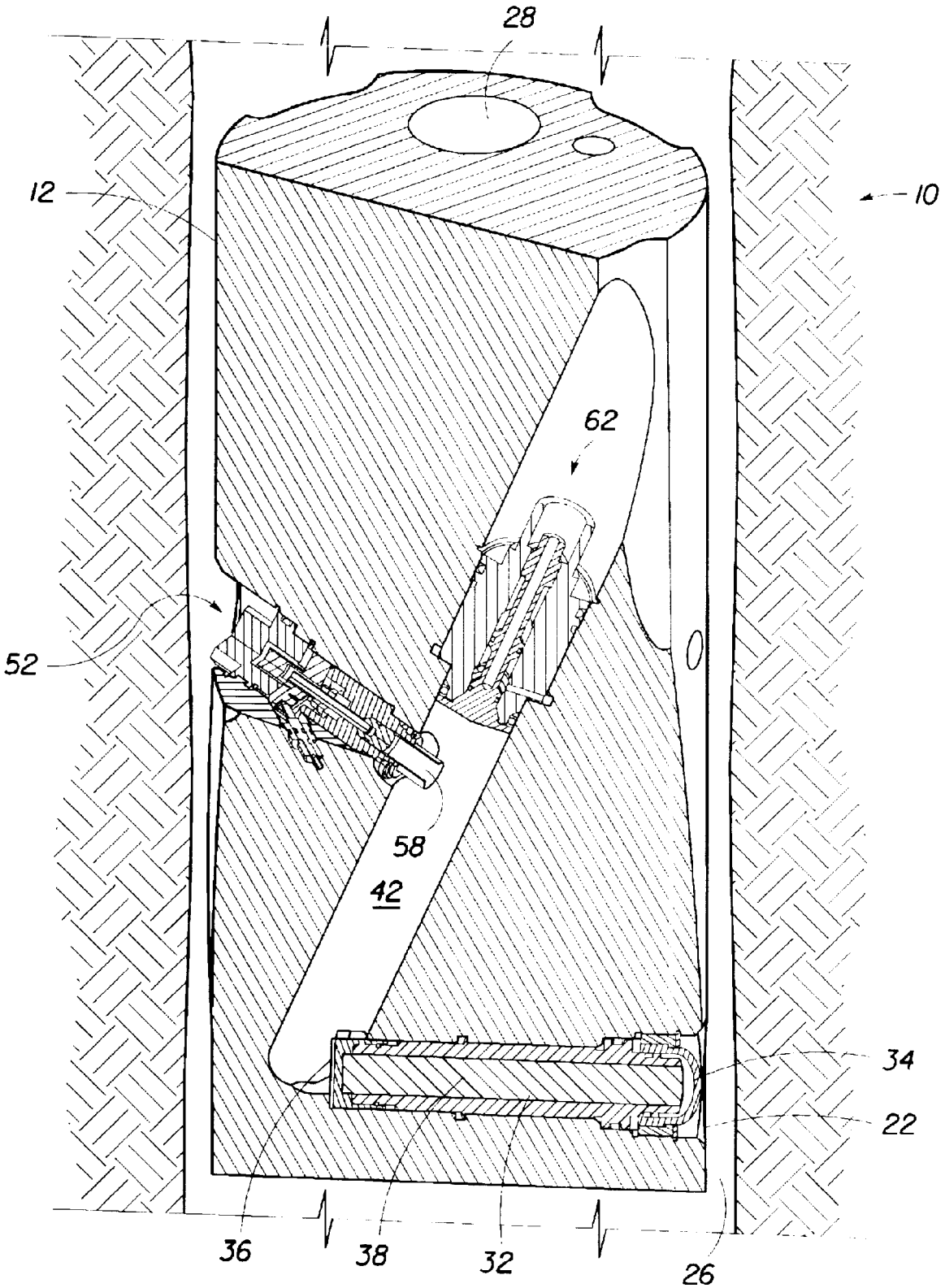
FIG. 2 is a cross-sectional view of the drill collar propellant gun of the present invention disposed within a drill collar for deploying a data sensing apparatus into a selected subsurface formation.

FIG. 2 shows a cross-sectional view of the drill collar propellant gun 10 of the present invention. The barrel 32 is shown as being oriented substantially planar with cross-section of the wellbore that is generally perpendicular to the axis of the wellbore at that depth. Those skilled in the art will appreciate that such lateral embedding of a data sensing apparatus radially outward away from the axis of the wellbore need not necessarily be perpendicular to the axis of the wellbore, but may be accomplished through numerous angles of attack into the desired formation of interest.

The barrel 32 terminates at the orifice 22 in the wall of the drill collar 12. The data sensing apparatus, upon deployment, passes through the orifice 22 as it exits the drill collar 12. The hollow interior 38 of the barrel 32 is substantially uniform along its length and is sized to receive and temporarily store the data sensing apparatus 24. The muzzle cap 34 isolates the hollow interior 38 of the barrel 32 from the drilling mud 26 (or other fluid, such as completion fluid) residing in the annular area between the drill string and the side wall of the wellbore. The muzzle cap 34 is designed to withstand any hydrostatic pressure exerted on the drill collar propellant gun 10 by the column of drilling mud (or other fluid) in the well, but to shatter upon impact by the accelerated data sensing apparatus 24 or the rapidly moving gas immediately preceding deployment of the data sensing apparatus 24. A ceramic material such as Alumina is presently preferred for this purpose. Alternatively, the muzzle cap may be metallic so that it's pierceable by egress of the data sensing apparatus, and "peels away," with a minimal loss of energy.

The burn chamber 42 is adapted to receive or store a propellant like those described in U.S. patent application Ser. No. 09/458,764 now abandoned. The burn chamber 42 provides a space for disposing a propellant into intimate contact with an ignition assembly 52 having an igniter 58 disposed in the burn chamber 42. The ignition assembly 52 ignites the propellant disposed into the burn chamber 42 thereby resulting in a substantially rapid expansion of gas within the burn chamber 42 reaching a pressure up to or exceeding 100,000 pounds per square inch. The pressure caused by ignition of the propellant provides the driving force for acceleration, ejection and deployment of the data sensing apparatus 24. The accelerated data sensing apparatus 24 moves from the barrel 32 through the sacrificially shattering muzzle cap 34 and out the orifice 22 to be substantially embedded into the formation rock matrix 20.

In a preferred embodiment, the burn chamber 42 is isolated from the barrel 32 by a rupture disk 36. The rupture disk 36 is an engineered pressure diaphragm that is designed to rupture and relieve pressure at a predetermined threshold pressure achieved during the expansion of gases resulting from ignition of the propellant. The rupture disk 36 affords improved deployment of the data sensing apparatus by delaying the onset of acceleration of the data sensing apparatus within the barrel 32 until the pressure in the burn chamber 42 reaches a threshold pressure sufficient to cause the rupture disk 36 to fail. The rupture disk 36 fails at a predetermined elevated pressure, thereby causing a more rapid pressurization of the portion of the barrel 32 between the rupture disk 36 and the data sensing apparatus 24 than would be achieved if the burn chamber 42 were initially in fluid communication with the barrel 32. This more rapid pressurization results in a more rapid or instantaneous acceleration of the data sensing apparatus 24 within the hollow interior 38 of the barrel 32, and a greater exit velocity of the data sensing apparatus 24 upon firing of the drill collar propellant gun 10. Other means, such as shear pins or sacrificial threads, for holding the data sensing apparatus until a desired pressure level is reached in the burn chamber, may also be used to advantage with the present invention.

As shown in FIG. 1, the drill collar propellant gun 10 is contained within a drill collar 12 that is made up in a drill string above the drill bit 14. When drilling mud is circulated in the well, it must pass through the drill string and the drill bit 14, and return to the surface through the annular area between the drill string and the wellbore.

FIG. 2 shows a channel 28 passing through the drill collar propellant gun 10 to provide drilling mud flow to the drill bit 14 to lubricate the drill bit 14, suspend drill cuttings and carry them to the surface for removal. The channel 28 is isolated from the burn chamber 42 and the barrel 32 of the drill collar propellant gun 10 throughout the length of the drill collar 12.

Figure 3:
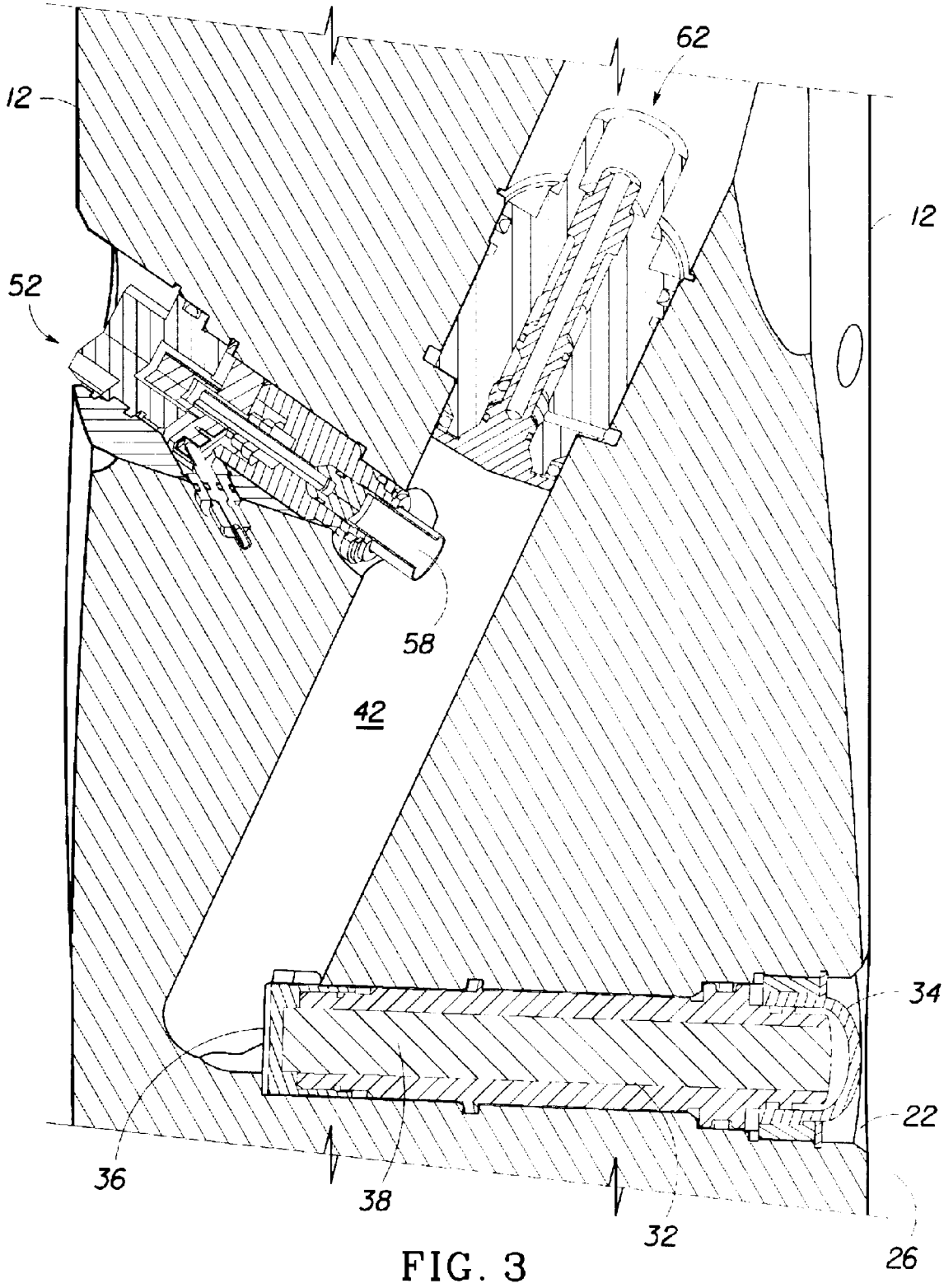
FIG. 3 is a cross-sectional view of the arrangement of the barrel relative to the burn chamber and the igniter protruding into the burn chamber in a preferred embodiment of the drill collar propellant gun of the present invention.

FIG. 3 shows a cross-sectional view of the preferred arrangement of the barrel 32 and the burn chamber 42. Assuming a standard 6.75-inch outside diameter drill collar, the maximum length of the barrel 32 that can be accommodated horizontally within the drill collar is about 5 inches. Even with larger diameter drill collars, the barrel length that can be accommodated within the drill collar 12 is still relatively small, in ballistic terms, as compared to the length of the data sensing apparatus (2.5 to 4 inches). In conventional gun-type devices having a relatively long barrel portion, the burn chamber is generally aligned with the barrel. However, in short-barrel configurations such as that involved with data sensing apparatus deployment in the present invention, acceleration of the data sensing apparatus is best achieved with near adiabatic expansion of the high pressure gas provided by ignition of the propellant and from which force is transferred to the data sensing apparatus. It is desirable to have near adiabatic expansion to achieve maximum force transfer from the propellant gas to the data sensing apparatus 24. This requires that the burn chamber 42 of the present invention be non-aligned with the barrel 32 as shown in FIGS. 2 and 3 in order to fit both the barrel 32 and the burn chamber 42 within the limited space in the drill collar 12. FIG. 3 shows that the burn chamber 42 of the drill collar propellant gun 10 of the present invention is substantially non-aligned with the barrel 32 enabling maximum length of the portion of the barrel 32 through which the data sensing apparatus 24 may be accelerated prior to its shattering the muzzle cap 34 and its ejection from the drill collar 12 through the orifice 22.

Figure 4:
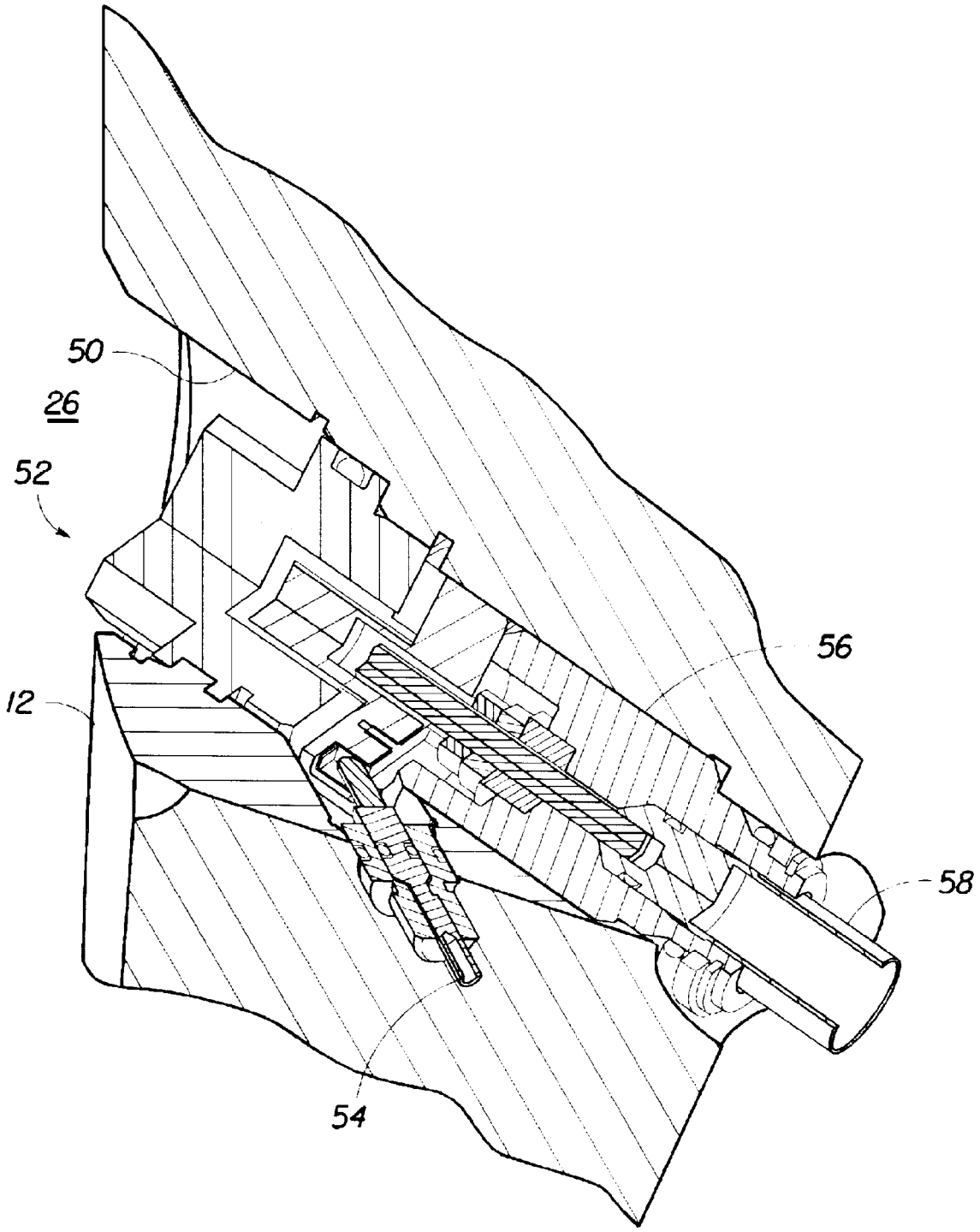
FIG. 4 is a cross-sectional view of the ignition assembly of the drill collar propellant gun of the present invention.

FIG. 4 shows a quartered cross-sectional view of the ignition assembly 52 which may be sealably and interchangeably disposed into an ignition assembly port 50 formed in the wall of the drill collar 12. The ignition assembly 52 is controlled through an electrical connection 54 which, when remotely activated, triggers igniter 58 that protrudes into the burn chamber 42 (not shown in FIG. 4). In the preferred embodiment, igniter 58 contains a small quantity of a high energy chemical charge that is activated by a heat source or mechanical impact/shock. The heat source (as well as the mechanical impact) can be triggered or generated by an electrical signal, such as that provided via electrical connection 54. Once the high energy chemical charge is activated, propellant burning commences and high pressure gas is generated.

Figure 5:
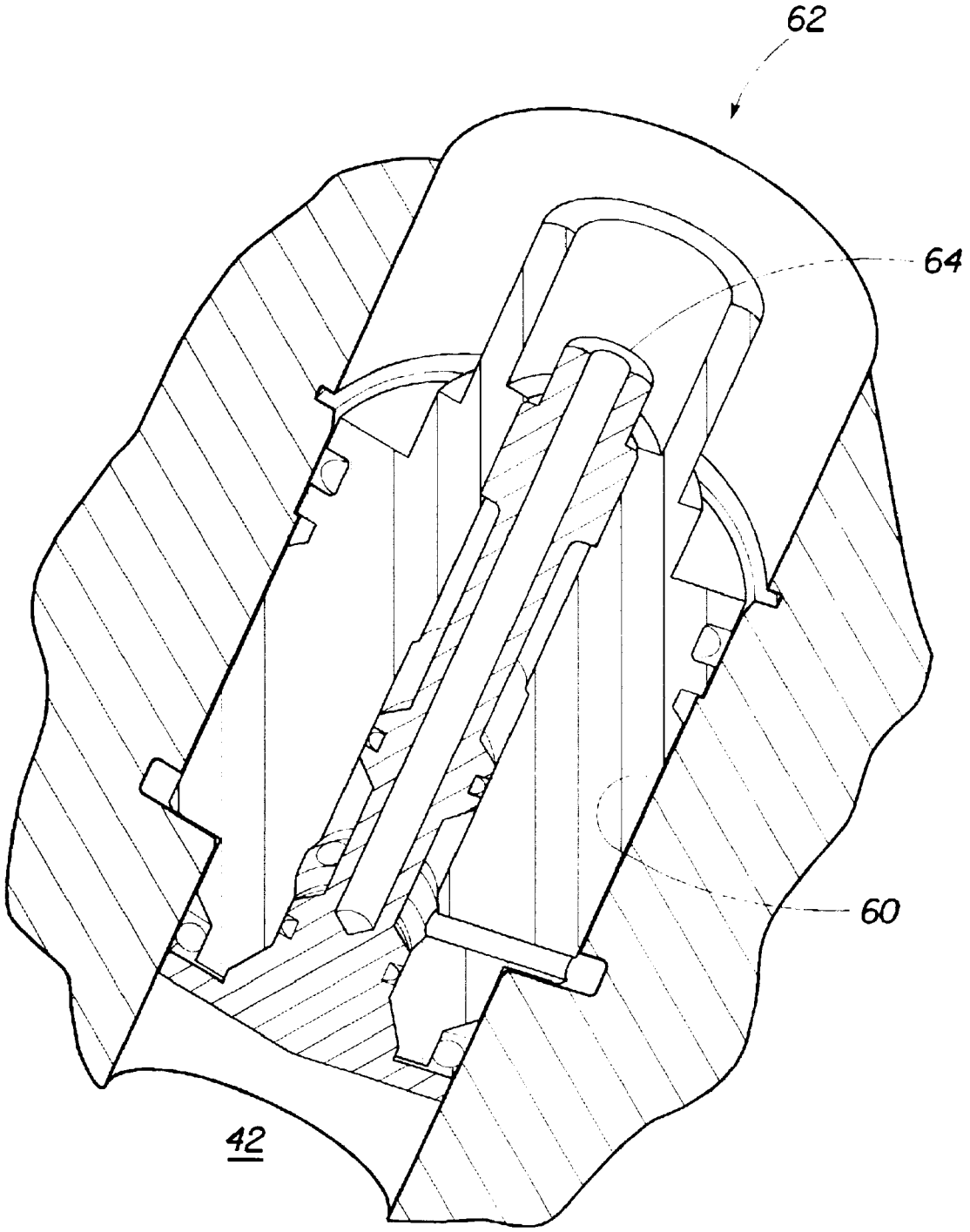
FIG. 5 is a cross-sectional view of the pressure relief assembly and related components of the drill collar propellant gun of the present invention.

FIG. 5 shows cross-sectional view of the pressure relief assembly 62 that may be sealably and interchangeably disposed into a pressure relief assembly port 60 formed in the drill collar 12. One purpose of the pressure relief assembly 62 is to provide a means for relieving trapped pressure remaining in the burn chamber 42 after an unsuccessful deployment of a data sensing apparatus. In the event that the chemical propellant becomes wet or otherwise compromised, the pressure resulting from ignition of the propellant may not result in rupture of the rupture disk 36. In this event, the pressure relief assembly 62 may be used to safely release the trapped pressure within the burn chamber 42 in a controlled manner. Removal of the pressure relief assembly 62 and the ignition assembly 52 provide access to the burn chamber for cleaning and maintenance, or for disposing measured amounts of the chemical propellant. A preferred arrangement of pressure relief assembly 62 and ignition assembly 52 is shown in FIG. 2, but the locations of the two assemblies may be switched if desirable.

General ballistics principles help determine the essential projectile parameters for the data sensing apparatus drill collar propellant gun 10. Design considerations include the required speed and weight of the data sensing apparatus necessary to achieve sufficient penetration of a given rock, the length/cross-section ratio to ensure straight flight of the data sensing apparatus and nose shape of the data sensing apparatus for optimum penetration depth. The data sensing apparatus 24 is therefore substantially bullet-shaped and is elongated about its axis to partially satisfy the second constraint (sufficient, straight penetration) expressed above.

The drill collar propellant gun 10 may be remotely controlled using a transmitter/receiver combination. A receiver within the drill collar propellant gun 10 may receive commands through radio frequency (RF) or other electromagnetic means, or through mud telemetry systems. These devices and methods for communicating data and commands to remotely controlled devices in a wellbore are known in the prior art. Communication with a remote transmitter or receiver using RF signals requires that an antenna be part of the drill collar propellant gun 10, and such an antenna used for control purposes must be protected against the burn chamber pressure and temperature and protected from all impact forces.

The data sensing apparatus 24 includes a substantially bullet-shaped shell equipped with encapsulated data sensor for indicating one or more properties of a subsurface formation of interest. The data sensing apparatus includes a transmitter for transmitting a signal representative of the sensor-indicated property to a remote data receiver. The data sensing apparatus may include a receiver for receiving remotely transmitted signals used by the data sensing apparatus to determine the optimal transmission frequency for communicating formation data to the remote receiver.

Those skilled in the art will appreciate that the present invention also contemplates the deployment of intelligent sensor apparatus 24 from a wireline tool, even though the description herein refers to an apparatus for data sensing apparatus deployment from a drill collar propellant gun made up in a drill collar of a drill string.

In contrast to present day operations, the present invention makes formation pressure and temperature data, as well as other formation evaluation data (e.g., resistivity, gamma ray, density, and neutron measurements), intermittently or continuously available while drilling or producing fluids from the formation of interest. This advantage enables better decisions concerning drilling mud weight and composition at a much earlier time in the drilling process without necessitating costly tripping of the drill string for the purpose of running a conventional formation tester. Once a data sensing apparatus is remotely deployed using the present invention, intermittent or continuous accurate formation data may be obtained while drilling, a feature that is not possible according to currently known drilling techniques.

Monitoring of pressure in penetrated formations may continue as long as communication with the data sensing apparatus is available. This feature is dependent of course on the nature of the communication link between the transmitter/receiver circuitry within the drill collar and any deployed intelligent remote sensors. It is contemplated by and within the scope of the present invention that the remote data sensing apparatuses, once deployed in the formation, will have the benefit of stored energy in the form of a battery, fuel cell or other energy source, and may provide a source of formation data for a substantial period of time. It is further contemplated that a replaceable or auxiliary source of stored energy may be adapted to be received by the deployed data sensing apparatus exposed to the wellbore for periodically restoring the energy source supporting continued data transmission from the data sensing apparatus.

In view of the foregoing it is evident that the present invention is well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive. The scope of the invention is indicated by the claims that follow rather than the foregoing description, and all changes which come within the meaning and range of equivalence of the claims are therefore intended to be embraced herein.

What is claimed is:

1. An apparatus for deploying a data sensing apparatus into a subsurface geologic formation comprising:

a barrel adapted for receiving the data sensing apparatus;

a burn chamber adapted for receiving a propellant material;

a barrier disposed to provide selective fluid communication between the barrel and the burn chamber;

an igniter in communication with the burn chamber for igniting the propellant whereby pressure is created to activate the barrier and deploy the data sensing apparatus into the subsurface formation for communication therewith; and a pressure relief valve for relieving pressure from within the burn chamber.

2. The apparatus of claim 1 further comprising a projectile disposed in the barrel.

3. The apparatus of claim 2 wherein the projectile is a data sensing apparatus.

4. The apparatus of claim 1 wherein the barrier is a rupture disk that isolates the burn chamber from the barrel.

5. The apparatus of claim 4 wherein the rupture disk is designed to rupture upon the propellant achieving a predetermined gas pressure in the burn chamber thereby providing fluid communication between the burn chamber and the barrel.

6. The apparatus of claim 1, wherein the barrel has an outlet and a sacrificial seal secured over the outlet.

7. The apparatus of claim 1, wherein the igniter is disposed at an opposite end of the burn chamber from the rupture disk.

8. The apparatus of claim 1, wherein the apparatus is positioned in a tool having a mud channel extending through the tool.

9. A method of deploying a data sensing apparatus into a subsurface formation penetrated by a wellbore, comprising the steps of:

loading the data sensing apparatus into the barrel of a deployment apparatus;

loading a propellant into a burn chamber of the deployment apparatus, the burn chamber being in selective communication with the barrel;

lowering the deployment apparatus into the wellbore adjacent a subsurface formation of interest;

igniting the propellant within the burn chamber while fluidly isolating the burn chamber from the barrel; and communicating the pressure of the ignited propellant within the burn chamber to the barrel when the pressure reaches a predetermined magnitude, whereby the data sensing apparatus is deployed from the barrel into the subsurface formation for communication therewith, the deployment apparatus including a pressure relief valve for relieving pressure developed within the burn chamber in case the pressure of the ignited propellant within the burn chamber is not communicated to the barrel.

10. The method of claim 9, wherein the data sensing apparatus is a bullet-shaped projectile.

11. The method of claim 9, wherein the burn chamber is fluidly isolated from the barrel by a barrier.

12. The method of claim 11, wherein the barrier is a rupture disk.

13. The method of claim 12, wherein the rupture disk is designed to rupture upon the propellant achieving a predetermined gas pressure in the burn chamber thereby providing fluid communication between the burn chamber and the barrel.

14. The method of claim 9, wherein the barrel has an outlet and a sacrificial seal secured over the outlet.

15. The method of claim 14, wherein the data sensing apparatus pierces the sacrificial seal as it is forcibly deployed from the barrel.

16. The method of claim 9, wherein an igniter is disposed at an opposite end of the burn chamber from the rupture disk to ignite the propellant in the burn chamber.

17. The method of claim 9, wherein the deployment apparatus is a wireline tool and is lowered into the wellbore via a wireline.

18. The method of claim 9, wherein the deployment apparatus is lowered into the wellbore via a drill string.

19. The method of claim 18, wherein the deployment apparatus is a drill collar.

20. An apparatus for deploying a data sensing apparatus into a subsurface formation, comprising:

a barrel adapted for receiving the data sensing apparatus;

a burn chamber adapted for receiving a propellant material and connected to the barrel at an interface;

a barrier positioned at the interface to provide selective fluid communication between the barrel and the burn chamber;

an igniter placed in communication with the burn chamber, whereby ignition of the propellant by the igniter causes gas expansion within the burn chamber which penetrates the barrier and deploys the data sensing apparatus from the barrel into the subterranean formation for communication therewith; and a relief valve for relieving the pressure within the burn chamber should the gas expansion not produce sufficient pressure to penetrate the barrier.

21. The apparatus of claim 20, wherein the barrel has an open end for deploying the data sensing apparatus therethrough, and further comprising a sealing member positioned to seal the open end of the barrel to prevent the ingress of drilling fluid into the barrel when the apparatus is disposed in a drill string.

22. The apparatus of claim 21, wherein the sealing member comprises a ceramic material, permitting the sealing member to shatter when the data sensing apparatus is deployed.

23. The apparatus of claim 21, wherein the sealing member comprises a metallic material, permitting the sealing member to tear open when the data sensing apparatus is deployed.

24. An apparatus for deploying a data sensing apparatus into a subsurface geologic formation comprising:

a barrel adapted for receiving the data sensing apparatus, the barrel having an open end for deploying the data sensing apparatus therethrough;

a burn chamber adapted for receiving a propellant material;

a barrier disposed to provide selective fluid communication between the barrel and the burn chamber;

an igniter in communication with the burn chamber; and a sealing member positioned to seal the open end of the barrel to prevent the ingress of drilling fluid into the barrel when the apparatus is disposed in a drill string, the sealing member comprising a ceramic material, permitting the scaling member to shatter when the data sensing apparatus is deployed.

25. An apparatus for deploying a data sensing apparatus into a subsurface formation, comprising:

a barrel adapted for receiving the data sensing apparatus, the barrel having an open end for deploying the data sensing apparatus therethrough;

a burn chamber adapted for receiving a propellant material and connected to the barrel at an interface;

a barrier positioned at the interface to provide selective fluid communication between the barrel and the burn chamber; and an igniter placed in communication with the burn chamber, whereby ignition of the propellant by the igniter causes gas expansion within the burn chamber which penetrates the barrier and deploys the data sensing apparatus from the barrel into the subterranean formation for communication therewith; and a scaling member positioned to seal the open end of the barrel to prevent the ingress of drilling fluid into the barrel when the apparatus is disposed in a drill string, the sealing member comprising a ceramic material, permitting the scaling member to shatter when the data sensing apparatus is deployed.

* * * * *